US006287396B1

(12) United States Patent
Tanaka et al.

(10) Patent No.: US 6,287,396 B1
(45) Date of Patent: Sep. 11, 2001

(54) THREADED PARTS FOR AIRCRAFT

(75) Inventors: Koichi Tanaka; Shinichi Tanaka; Noriyoshi Tsuji, all of Osaka (JP)

(73) Assignees: Tanaka Limited; SDC Incorporated, both of Osaka (JP)

( * ) Notice: Subject to any disclaimer, the term of this patent is extended or adjusted under 35 U.S.C. 154(b) by 0 days.

(21) Appl. No.: 09/400,868

(22) Filed: Sep. 21, 1999

(30) Foreign Application Priority Data

Oct. 16, 1998 (JP) ..... 10-295564

(51) Int. Cl.[7] ..... C23C 8/22
(52) U.S. Cl. ..... 148/316
(58) Field of Search ..... 148/316, 319; 411/411

(56) References Cited

U.S. PATENT DOCUMENTS 4,410,374 * 10/1983 Urabe ..... 148/143
4,844,949 * 7/1989 Arai et al. ..... 427/213
5,362,523 * 11/1994 Gorynin et al. ..... 427/446
5,799,683 * 9/1998 Hamada et al. ..... 137/15
5,887,853 * 3/1999 Holmes et al. ..... 251/335.2

* cited by examiner

*Primary Examiner*—John Sheehan
(74) *Attorney, Agent, or Firm*—Wenderoth, Lind & Ponack, L.L.P.

(57) ABSTRACT

Threaded parts for aircraft made of heat-resistant steel which will never seize even after subjected to large temperature fluctuations and vibrations for a long time. Thus they can be tightened sufficiently and also loosened for maintenance and inspection. The threaded parts are made of heat-resistant steel and having its surface subjected to carburizing so as to satisfy the following equations:

$$0 \leqq X \leqq 100,$$

$$Y \geqq -10X+600,$$

$$Y \leqq -6X+1000$$

where X is the depth ($\mu$m) from the surface of the threaded part and and Y is the Vickers hardness (HV).

2 Claims, 2 Drawing Sheets

THREADED PARTS FOR AIRCRAFT

BACKGROUND OF THE INVENTION

This invention relates to threaded parts for aircraft which are used under extremely large temperature fluctuations, and more particularly to threaded parts for aircraft made of heat-resistant steel.

Threaded parts such as nuts and bolts used for aircraft are required to stably and reliably maintain their function and quality even under conditions far severer than normally expected use conditions to ensure safety of aircraft. This requirement is especially severer for threaded parts used in portions associated with aircraft engines and fuselages because the failure of such threaded parts can directly lead to a grave accident and also threaded parts used in such portions are subjected to especially large temperature fluctuations.

Threaded parts used at such portions are typically exposed to extremely cold air at high altitude, cold air from cooled portions of the aircraft or low temperatures conducted therefrom, and hot air from engines or heat conducted therefrom. Thus, resistance to thermal stress is also required for such threaded parts.

Typical materials for such threaded parts for aircraft include alloy steel, corrosion-resistant steel and heat-resistant steel SUH660 (A-286, JIS G 4311). Heat-resistant steel (SUH660) is an austenite Fe—Ni—Cr alloy of a precipitation-hardening type, and exhibits high strength and corrosion resistance up to 704° C. In the aerospace field, its maximum applicable temperature is said to be 649° C. (1200° F.). Thus, it is usually strengthened by aging treatment at 700–780° C.

Among threaded parts for aircraft, nuts and bolts used at or near combustion chambers of the engine tend to be subjected to severe thermal stresses. That is, these threaded parts tend to be partially or entirely subjected to thermal shocks due to temperature fluctuations ranging from about 600° C. to about 0° C. Safety consideration is therefore given to these parts so as not to be cracked or destroyed due to such thermal shocks.

Compared with alloy steel, threaded parts for aircraft made of heat-resistant steel are physically characterized by the facts that thermal conductivity is about 1/3, that thermal expansion coefficient is about 1.5 times higher, and that friction coefficient is high. Due to synergistic effect of these characteristics, threaded parts tend to seize (or stick fast through excessive heat and get locked and unturnable) when tightened by power tools or hand wrenches. Thus, to prevent seizure, conventional such threaded parts are electrically plated with cadmium or nickel, or have their threaded surface coated with a resin containing a lubricant.

Another problem is that when subjected to large temperature fluctuations and vibrations for a long period of time, their plated or resin coated layers tend to crack due to thermal stresses resulting from a difference in thermal expansion coefficient between the plated layer or resin coated layer and the heat-resistant steel substrate.

If subjected to thermal stresses repeatedly, these layers may peel off. Once outer layers peel off, two threaded parts meshing each other would be locally strained due to thermal expansion and eventually seize.

Once seized, threaded parts cannot be tightened any further nor loosened. Thus, removing seized threaded parts requires a lot of trouble. That is, they have to be cut. This may make maintenance of aircraft parts impossible.

An object of this invention is to provide threaded parts for aircraft made of heat-resistant steel which will never seize even after subjected to large temperature fluctuations and vibrations for a long time, and which can be easily tightened and loosened for maintenance and inspection.

SUMMARY OF THE INVENTION

According to this invention, there is provided a threaded part for use in aircraft, the threaded part being made of heat-resistant steel and having its surface subjected to carburizing so as to satisfy the following equations:

$$0 \leqq X \leqq 100,$$

$$Y \geqq -10X+600,$$

$$Y \leqq -6X30\ 1000$$

wherein X is the depth ($\mu$m) from the surface of the threaded part and Y is the Vickers hardness (HV).

Carburizing may be plasma carburizing in which carburizing and cleaning are carried out at 600–900° C. The surface of the thus made threaded part embodying the present invention, including the carburized threaded surface, is low in friction coefficient. From the surface to a predetermined depth, the relation between the depth (X) from the surface and the hardness (Y) satisfies predetermined equations. That is, the nearer to the surface, the harder, and the deeper, the softer. In short, it is carburized like a gradient material.

Since the threaded parts made of heat-resistant steel for aircraft according to this invention has a hard and low-friction carburized surface, it can be tightened easily and is less likely to be worn. Also, since there is no clear boundary between the heat-resistant steel substrate and the carburized portion, which means that no clear hardened surface layer is formed on the substrate, there is no large difference in thermal expansion coefficient between the carburized portion and the substrate and no thermal stress will be produced even if used over a wide range from high to low temperatures.

Thus, even when the threaded parts according to this invention are subjected to high temperature after tightened, they are less likely to be strained or deformed due to thermal stress. Even if they are used for a long time at or near combustion chambers of aircraft engines as nuts and bolts, they will never seize, so that they can be tightened completely, and also can be easily loosened and removed for maintainance and inspection.

DETAILED DESCRIPTION OF THE PREFERRED EMBODIMENT

The threaded part according to this invention is made from heat-resistant steel SUH660 (A-286) (JIS G 4311). Its composition is defined under JIS (Japan Industrial Standards).

The term "threaded part" herein used refers to any parts partially formed with threads, such as nuts and bolts. Their shape is not limited.

Figure 1:
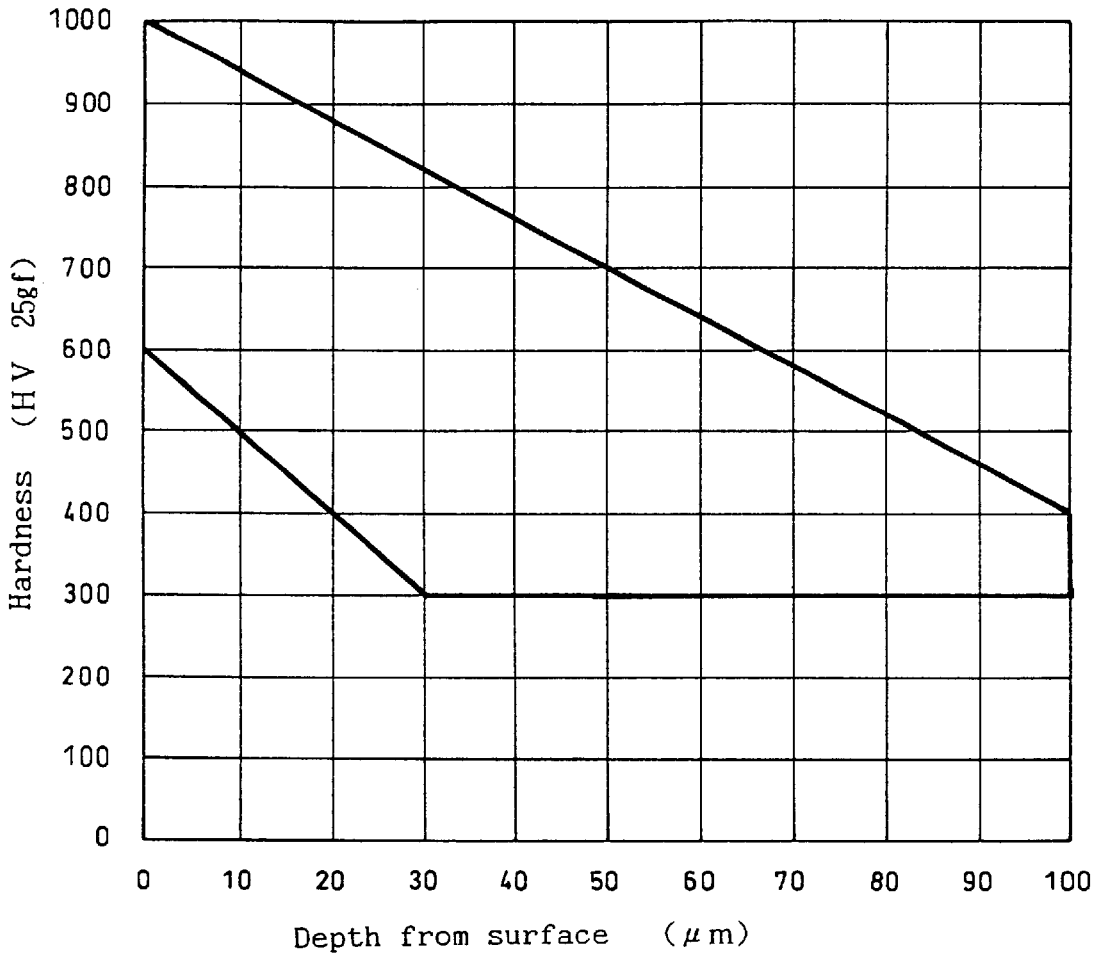
FIG. 1 is a graph showing the relationship between the depth (X) from the part surface and the hardness (Y)

Carburizing according to this invention may be of any known type such as plasma carburizing. Carburizing conditions such as carburizing temperature, time, and aging treatment should be adjusted so that the relation between depth (X) from the surface and the hardness will be inside the range enclosed by the thick lines in FIG. 1.

More specifically, the following equations have to be met:

$$0 \leqq X \leqq 100,$$

$$Y \geqq -10X+600$$

$$Y \leqq -6X+1000$$

wherein X is the depth ($\mu$m) from the surface of the threaded part and Y is the Vickers hardness (HV).

For plasma carburizing, a known carburizing device described below may be used: a treating chamber enclosed by a heat-insulating material e.g. graphite fiber is formed in a heating furnace; the chamber is heated by a heater comprising a graphite rod; an anode for direct-current glow discharge is connected to the top of the chamber; its cathode is connected to a table on which an article to be treated is placed; gas manifolds are provided in the chamber through which processing and cleaning gases such as hydrocarbon, nitrogen, argon or hydrogen gas are introduced into the chamber.

Hydrocarbon gases used for carburizing are gases consisting essentially of carbon and hydrogen and may be either a chain hydrocarbon or a cyclic hydrocarbon. Typical chain hydrocarbons include paraffinic hydrocarbons expressed by $C_nH_{2n+2}$, olefinic hydrocarbons expressed by $C_nH_{2n}$, and acetylenic hydrocarbons expressed by $C_nH_{2n-2}$. They may be straight-chained or have side chains. Methane, ethane, propane and butane are especially preferable because they are gaseous at normal temperature and thus require no vaporizing facilities. Cyclic hydrocarbons may be either aromatic compounds or cycloaliphatic ones. Typical aromatic compounds include benzene $C_6H_6$.

Plasma carburizing is now described in more detail. With a blank for the threaded parts placed in the chamber, the chamber is exhausted and heated to 400–900° C. by a heater, then an inert gas for cleaning such as argon gas is introduced, and a high DC voltage of 200–1500 V is applied. This state is maintained for 10–60 minutes.

The introduced gas turns into a plasma. The potential in the plasma is substantially uniform in the most part from anode to cathode, but drops suddenly near the cathode. Thus, inert gas such as argon ions Ar+ in the plasma is accelerated due to the cathode fall, and collides against the surface of the heat-resistant steel, thus sweeping off any debris adhered to its surface and cleaning the surface. Up to 60 minutes, the longer the cleaning time, the higher the efficiency of the subsequent carburizing and the hardness of the carburized layer. Longer-than-60-minutes cleaning is however a waste of time and money.

When a hydrocarbon gas such as methane gas is introduced at a pressure of 0.1–5 Torr, and heated to 600–900° C., ionized active carbon ions C+ are produced in the plasma gas. The ions produced will adhere to the surface of the heat-resistant steel and diffuse into the steel. The active carbon ions diffusing into the steel partially remain in the carburized layer, and the remainder combines with the steel and forms a carbide.

If a mix of hydrocarbon gas and a diluting gas such as hydrogen gas ($H_2$) is used, the partial pressure of the hydrocarbon gas is adjusted to 0.1–5 Torr. Specifically, if only a hydrocarbon gas such as $C_3H_8$, $CH_4$, $C_2H_2$ is used for carburizing, the pressure is preferably 0.4–2 Torr. If a mix of $C_3H_8$ and hydrogen gas is used, the partial pressure of $C_3H_8$ is preferably adjusted to 0.1–5 Torr with the partial pressure of hydrogen gas adjusted to 0.2–15 Torr, and the total pressure of the gas mix to 0.3–20 Torr.

If the pressure of hydrocarbon gas or the partial pressure of the hydrogen gas in the gas mix is below the above predetermined range, a carbide is difficult to form in the carburizing layer and carbon ions are difficult to diffuse into the steel. Thus, a sufficiently deep carburized layer would not be formed. On the other hand, if the pressure is above the above predetermined range, a carbon film would be formed on the material to be treated, making difficult diffusion of carbon into the steel.

Plasma carburizing according to this invention is preferably carried out at 600–900° C., and more preferably at 700–780° C. because better results are obtained if the temperature is substantially equal to the aging temperature for heat-resistant steel. At a temperature lower than 700° C., a glassy carbon film tends to form on the surface, which makes it difficult to form a smooth gradient in which the deeper the carburizing, the less the hardness. Instead, at a certain depth, the hardness will drop suddenly. Hardness thus changes unstably in a stepwise manner. Carburizing at higher temperature than 900° C. would soften the entire substrate, so that desired hardness is not achievable.

In such a carburizing temperature range, the carburizing time should be 0.5–6 hours. It may be determined to satisfy the predetermined relation between the depth from the surface and the hardness under each carburizing temperature condition.

EXAMPLE 1

Bolt-shaped test pieces formed from heat-resistant steel SUH660 (A-286, JIS G 4311, wire 12.2 mm in outer diameter) were subjected to plasma carburizing under the following conditions.

A known carburizing device (made of NDK, Incorporated) was used in which a treating chamber in a heating furnace surrounded by a heat-insulating material such as graphite fiber was heated, an anode for direct-current glow discharge was connected to the top of the chamber, its cathode was connected to a table on which an article to be treated was placed, gas manifolds were placed in the chamber through which processing gases (carburizing gas and diluting gas) such as hydrocarbon, nitrogen, argon or hydrogen gas was introduced into the chamber.

First, a mix of argon gas (201 ml/min.) and hydrogen gas (24 ml/min.) was introduced into the chamber as a cleaning gas: cleaning temperature: 710° C., cleaning time: 20 minutes, cleaning gas pressure: 0.7 Torr, current: 0.3 amp, voltage: 430 V.

Then, for plasma carburizing, propane gas under pressure of 0.8 Torr was introduced into the chamber at the rate of 220 ml/min, and the carburizing temperature was maintained at 710° C. for 2 hours while applying a DC voltage of 570 V at 0.3 amp. After carburizing, nitrogen gas was introduced into the chamber to cool the test pieces to normal temperature.

Figure 2:
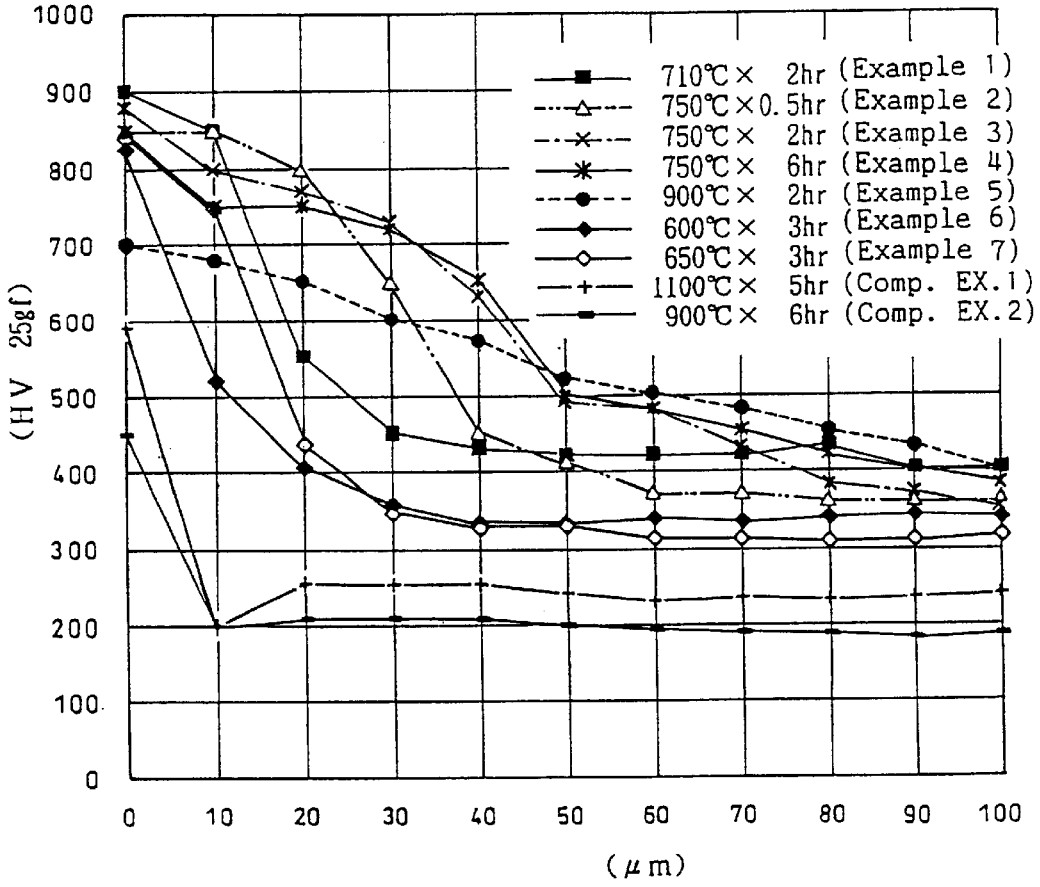
FIG. 2 is a similar graph showing data for the Examples and the comparative Examples.

For the thus treated test pieces of Example 1, Vickers harnesses (HV, load: 25 gf/15 sec.) from the surface to the depth of 100 $\mu$m were measured at 10 $\mu$m intervals. The results are shown in FIG. 2.

EXAMPLE 2

Except that the carburizing and cleaning temperatures were 750° C. and that the carburizing time was 0.5 hour, test pieces were carburized in exactly the same way as in Example 1, and Vickers hardness was measured.

EXAMPLE 3

Except that the carburizing and cleaning temperatures were 750° C. and that the carburizing time was 2 hours, test pieces were carburized in exactly the same way as in Example 1, and Vickers hardness was measured.

EXAMPLE 4

Except that the carburizing and cleaning temperatures were 750° C. and that the carburizing time was 6 hours, test pieces were carburized in exactly the same way as in Example 1, and Vickers hardness was measured.

EXAMPLE 5

Except that the carburizing and cleaning temperatures were 900° C. and that the carburizing time was 2 hours, test pieces were carburized in exactly the same way as in Example 1, and Vickers hardness was measured.

EXAMPLE 6

Except that the carburizing and cleaning temperatures were 600° C. and that the carburizing time was 3 hours, test pieces were carburized in exactly the same way as in Example 1, and Vickers hardness was measured.

EXAMPLE 7

Except that the carburizing and cleaning temperatures were 650° C. and that the carburizing time was 3 hours, test pieces were carburized in exactly the same way as in Example 1, and Vickers hardness was measured.

Comparative Example 1

Except that the carburizing and cleaning temperatures were 1100° C. and that the carburizing time was 5 hours, test pieces were carburized in exactly the same way as in Example 1, and Vickers hardness was measured.

Comparative Example 2

Instead of plasma carburizing, gas carburizing was carried out using RX gas ($N_2$ 40%, $H_2$ 40%, CO 20%) at pressure of 1 Torr at 900° C. for 6 hours, and Vickers hardness was measured.

The results of measurement are shown in FIG. 2.

As will be apparent from the results shown in FIG. 2, the test pieces of Comparative Examples 1 and 2 had a surface hardness of less than 600 HV, which is too low for threaded parts for aircraft. Moreover, the hardness dropped suddenly at the depth of 10 μm from the surface. This increases the possibility of severe thermal stresses being produced under wide temperature fluctuations, and thus the possibility of peeling of the hardened layer.

In contrast, for the specimens of Examples 1–7, at least a portion including the threaded surface is hardened to a harness HV of 600 or over, and the hardness decreases smoothly and gradually to the depth of 100 μm until the carburized portion reaches and merges into the heat-resistant steel substrate.

Examples 1–7 and Comparative Examples 1 and 2 were subjected to a thermal shock test. In the test, under JIS H 8666, bolt-shaped test pieces of these Examples and Comparative Examples were put in a heating furnace heated to 650° C., left in the furnace for 10 minutes after they reached 650° C., taken out and air-cooled to normal temperature. The air-cooled test pieces were again put in the furnace and heated to 650° C. and retained for 10 minutes. This heating/air-cooling cycle was repeated 100 times. After the test, the surface of each test piece was observed under a microscope to see if they developed cracks or peelings.

For Comparative Examples 1 and 2, which had carburized layer formed by gas carburizing, cracks were observed, which indicates that the test pieces were subjected to thermal stresses.

In contrast, no peelings or peelings were observed on the surface of the plasma-carburized test pieces of Examples 1–7.

For test pieces of Examples 1–7, hardness changes gradually inwardly from the surface. Thus no thermal stresses are produced. This is why they are less likely to suffer cracks or laminar peeling even if subjected to large temperature fluctuations, and thus less likely to seize.

Thus, the threaded parts of this invention are less likely to be subjected to thermal stresses and thus less likely to seize even if subjected to large temperature fluctuations for a long time, so that they can be tightened completely and also can be loosened and removed easily for maintenance and inspection. Also, they are less likely to crack or peel.

What is claimed is:

1. A threaded part for use in aircraft, the threaded part being of heat-resistant steel and having its surface subjected to plasma carburizing so as to satisfy the the following equations:

$$0 \leqq X \leqq 100,$$

$$Y \geqq -10X + 600,$$

$$Y \leqq -6X + 1000$$

wherein X is the depth (μm) from the surface of the threaded part and Y is the Vickers hardness (HV).

2. The threaded part as claimed in claim 1 wherein said plasma carburizing is at a temperature of 600 to 900° C.

* * * * *